US007901220B2

(12) United States Patent
Kato

(10) Patent No.: US 7,901,220 B2
(45) Date of Patent: Mar. 8, 2011

(54) CONNECTOR HAVING A PLURALITY OF CONTACTS FORMED BY BLANKING AND BENDING AN ELASTIC METAL PLATE

(75) Inventor: Rintaro Kato, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 12/622,585

(22) Filed: Nov. 20, 2009

(65) Prior Publication Data

US 2010/0136849 A1 Jun. 3, 2010

(30) Foreign Application Priority Data

Dec. 2, 2008 (JP) ..... 2008-307321

(51) Int. Cl.
*H01R 12/00* (2006.01)

(52) U.S. Cl. ..... 439/79

(58) Field of Classification Search ..... 439/79, 439/80, 660, 885, 326
See application file for complete search history.

(56) References Cited

U.S. PATENT DOCUMENTS

| | | | | |
|---|---|---|---|---|
| 5,492,481 | A * | 2/1996 | Lewis | 439/159 |
| 5,636,999 | A * | 6/1997 | Hirai et al. | 439/79 |
| 6,132,243 | A * | 10/2000 | Hirata et al. | 439/541.5 |
| 6,174,197 | B1 * | 1/2001 | Hirata et al. | 439/541.5 |
| 6,217,347 | B1 * | 4/2001 | Schell et al. | 439/79 |
| 6,505,402 | B2 * | 1/2003 | Moriwake et al. | 29/883 |
| 6,666,695 | B1 * | 12/2003 | Yeh | 439/79 |
| 6,685,485 | B2 * | 2/2004 | Korsunsky et al. | 439/79 |
| 6,736,676 | B2 * | 5/2004 | Zhang et al. | 439/607.22 |
| 6,908,317 | B2 * | 6/2005 | Li | 439/79 |
| 6,923,662 | B2 * | 8/2005 | Sasame et al. | 439/79 |
| 6,926,542 | B2 * | 8/2005 | Li | 439/79 |
| 6,939,168 | B2 * | 9/2005 | Oleynick et al. | 439/541.5 |
| 2001/0049213 | A1 * | 12/2001 | Potters et al. | 439/80 |
| 2007/0178724 | A1 * | 8/2007 | Kemp et al. | 439/79 |
| 2008/0200049 | A1 * | 8/2008 | Shuey et al. | 439/79 |
| 2008/0318451 | A1 * | 12/2008 | Lu et al. | 439/79 |
| 2009/0258514 | A1 * | 10/2009 | He et al. | 439/79 |

FOREIGN PATENT DOCUMENTS

| | | |
|---|---|---|
| JP | 8-8034 | 1/1996 |
| JP | 2007-179960 | 7/2007 |

* cited by examiner

*Primary Examiner* — T C Patel
*Assistant Examiner* — Vladimir Imas
(74) *Attorney, Agent, or Firm* — Holtz, Holtz, Goodman & Chick, PC

(57) ABSTRACT

A connector is provided which realizes a narrower pitch of contact portions of contacts, and makes the arranging pitch of terminal portions of the contacts larger without increasing waste of material of the contacts. Signal contacts ground contacts which include contact portions, terminal portions, and connecting portions which connect the terminal portions are mounted in a housing. When the signal contacts and the ground contacts are blanked from an elastic metal plate, portions of the connecting portions and the terminal portions are inclined with respect to an imaginary plane orthogonal to a contact arranging direction.

8 Claims, 15 Drawing Sheets

CONNECTOR HAVING A PLURALITY OF CONTACTS FORMED BY BLANKING AND BENDING AN ELASTIC METAL PLATE

BACKGROUND OF THE INVENTION

1. Field of the Invention

This invention relates to a connector, and more particularly to a connector which includes a plurality of contacts formed by blanking and bending one elastic metal plate.

2. Description of the Related Art

Conventionally, there has been proposed a connector comprised of a housing, a plurality of pairs of signal contacts (differential signal contacts), and a plurality of ground contacts (see Japanese Laid-Open Patent Publication (Kokai) No. 2007-179960).

The plurality of pairs of signal contacts and the plurality of ground contacts are disposed in the housing along a predetermined arranging direction.

Each of the signal contacts and the ground contacts includes a terminal portion, a contact portion, and a connecting portion. The terminal portion is inserted through an associated one of through holes in a substrate. The contact portion is brought into contact with an associated one of contacts of a mating connector. The connecting portion connects between the terminal portion and the contact portion. The connecting portion is bent at right angles.

The connecting portion of each signal contact performs pitch changing in which the position of the terminal portion and the position of the contact portion are displaced in the arranging direction. This pitch changing widens spacing (spacing in the arranging direction) between the terminal portions of each pair of signal contacts, so that the adjacent through holes are not overlapped, which prevents short-circuit.

The contact portions of the signal contacts and the ground contacts are arranged in a row, and the terminal portions of the same are arranged in three rows.

According to the above-described conventional connector, it is possible to realize a narrower pitch of the contact portions, and at the same time, it is possible to increase the spacing between the terminal portions without increasing the size of the housing.

If it is intended to produce the above-described plurality of contacts by blanking and bending one elastic metal plate, the terminal portions of the adjacent contacts interfere with each other, so that it has been impossible to produce the contacts by such a method.

To make it possible to do this, it is only required to increase the pitch of the contacts in the arranging direction, blank the elastic metal plate, and then, reduce the pitch of the contacts in the arranging direction by bending a carrier (see Japanese Laid-Open Patent Publication (Kokai) No. H08-8034). However, this method necessitates an elastic metal plate having a large width (width in the contact arranging direction), which increases the amount of material which is disposed of after blanking, causing waste of resources.

SUMMARY OF THE INVENTION

The present invention has been made in view of these circumstances, and an object thereof is to provide a connector which is capable of realizing a narrower pitch of contact portions of contacts, and making the arranging pitch of the terminal portions of the contacts larger without increasing waste of material of the contacts.

To attain the above object, the present invention provides a connector comprising a housing, and a plurality of contacts that are formed by at least blanking an elastic metal plate, and are held by the housing in a predetermined arranging direction, the contacts each including a contact portion which is brought into contact with a first object to be connected, a terminal portion which is connected to a second object to be connected, and a connecting portion which connects the contact portion and the terminal portion, wherein portions of the connecting portions and the terminal portions of at least part of the plurality of contacts are inclined by a predetermined angle with respect to an imaginary surface orthogonal to the arranging direction so as not to interfere with other adjacent ones of the contacts during blanking.

With this arrangement of the connector according to the present invention, since the connecting portions and the terminal portions of at least part of the contacts out of the plurality of contacts are inclined by a predetermined angle with respect to the imaginary surface orthogonal to the arranging direction so as not to interfere with the connecting portions of the other adjacent contacts during blanking, it is possible to prevent adjacent ones of the contacts from being interfered with each other, without preparing an elastic metal plate having a large width in the contact arranging direction, as the elastic metal plate for making contacts.

Preferably, the plurality of contacts are formed by bending after being blanked, and the plurality of contacts each have a substantially square cross-section, the terminal portion of each of the plurality of contacts having a pin shape which is capable of being inserted through an associated one of through holes formed in the second object to be connected, and one surface of the terminal portions of at least part of the plurality of contacts being inclined by a predetermined angle with respect to the arranging direction, when in a state having been bent.

Preferably, the plurality of contacts include a plurality of pairs of signal contacts and a plurality of ground contacts, and the terminal portions of the signal contacts and the terminal portions of the ground contacts are arranged in two rows parallel to each other along the arranging direction, wherein imaginary straight lines connecting between the terminal portions of each pair of signal contacts in the row of the terminal portions of the signal contacts, and the terminal portions of each adjacent two of the ground contacts in the row of the terminal portions of the ground contacts, which are located in the vicinity of the terminal portions of the pair of the signal contacts, form a trapezoid.

Preferably, the plurality of contacts include a plurality of pairs of signal contacts and a plurality of ground contacts, the terminal portions of the signal contacts being arranged in two rows parallel to each other along the arranging direction, the terminal portions of the ground contacts being arranged in a row in the arranging direction between one row and the other row of the terminal portions of the signal contacts, wherein imaginary straight lines connecting between the terminal portions of each pair of signal contacts in the one row of the terminal portions of the signal contacts, and the terminal portions of each two of the ground contacts, which are located in the vicinity of the terminal portions of the signal contacts, form a trapezoid, and wherein imaginary straight lines connecting between the terminal portions of each pair of signal contacts in the other row of the terminal portions of the signal contacts, and the terminal portions of each two of the ground contacts, which are located in the vicinity of the terminal portions of the signal contacts, form an inverted trapezoid.

More preferably, the contact portions of the ground contacts are each disposed between the contact portions of adjacent ones of the pairs of the signal contacts in the arranging direction.

According to the present invention, it is possible to realize a narrower pitch of the contact portions of the contacts and making the arranging pitch of the terminal portions of the contacts larger without increasing waste of material of the contacts.

The above and other objects, features and advantages of the present invention will become more apparent from the following detailed description taken in conjunction with the accompanying drawings.

DETAILED DESCRIPTION OF THE PREFERRED EMBODIMENTS

The present invention will now be described in detail, with reference to the drawings showing preferred embodiments thereof.

Figure 1:
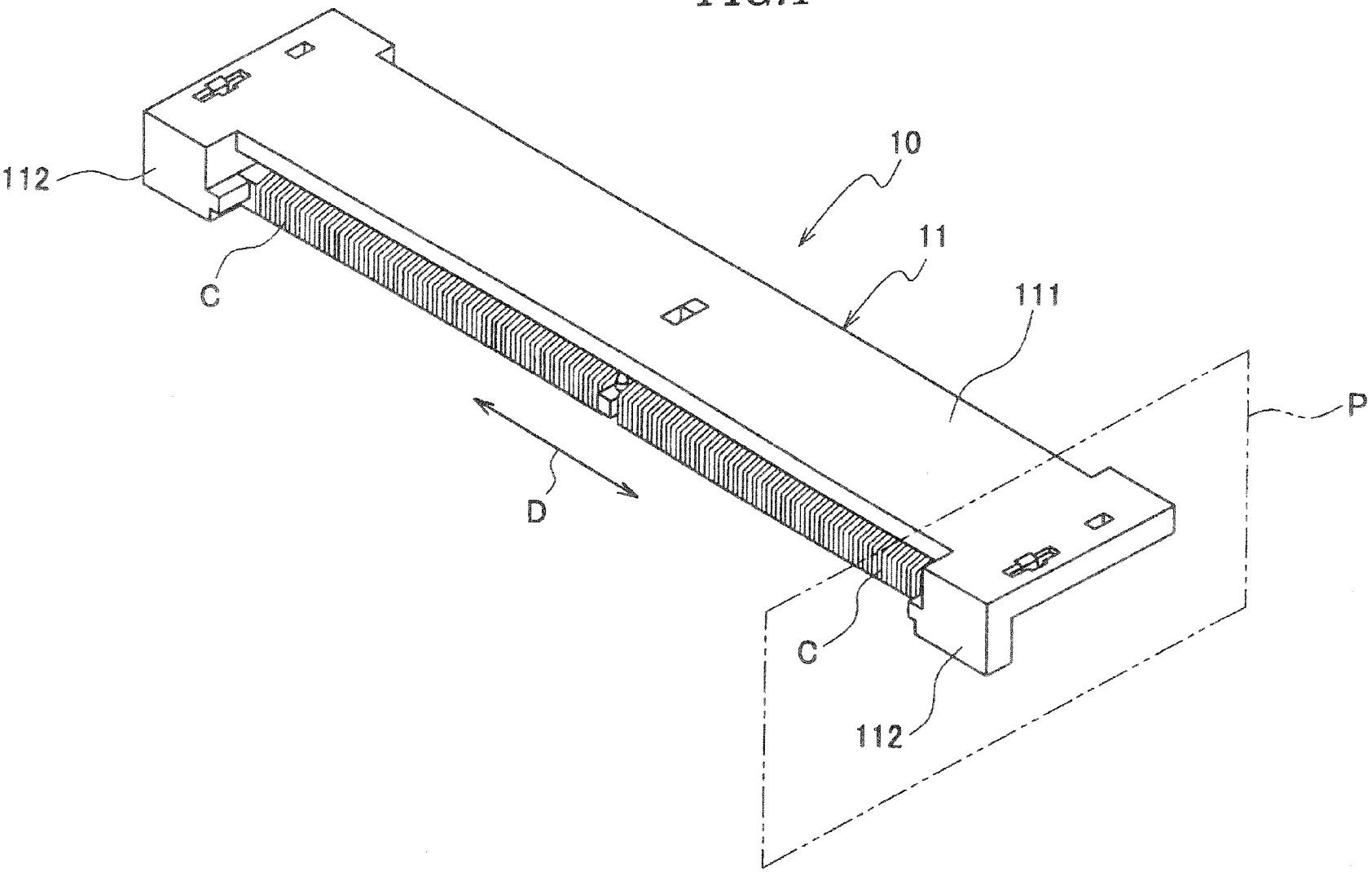
FIG. 1 is a perspective view of a connector according to a first embodiment of the present invention.
Figure 2:
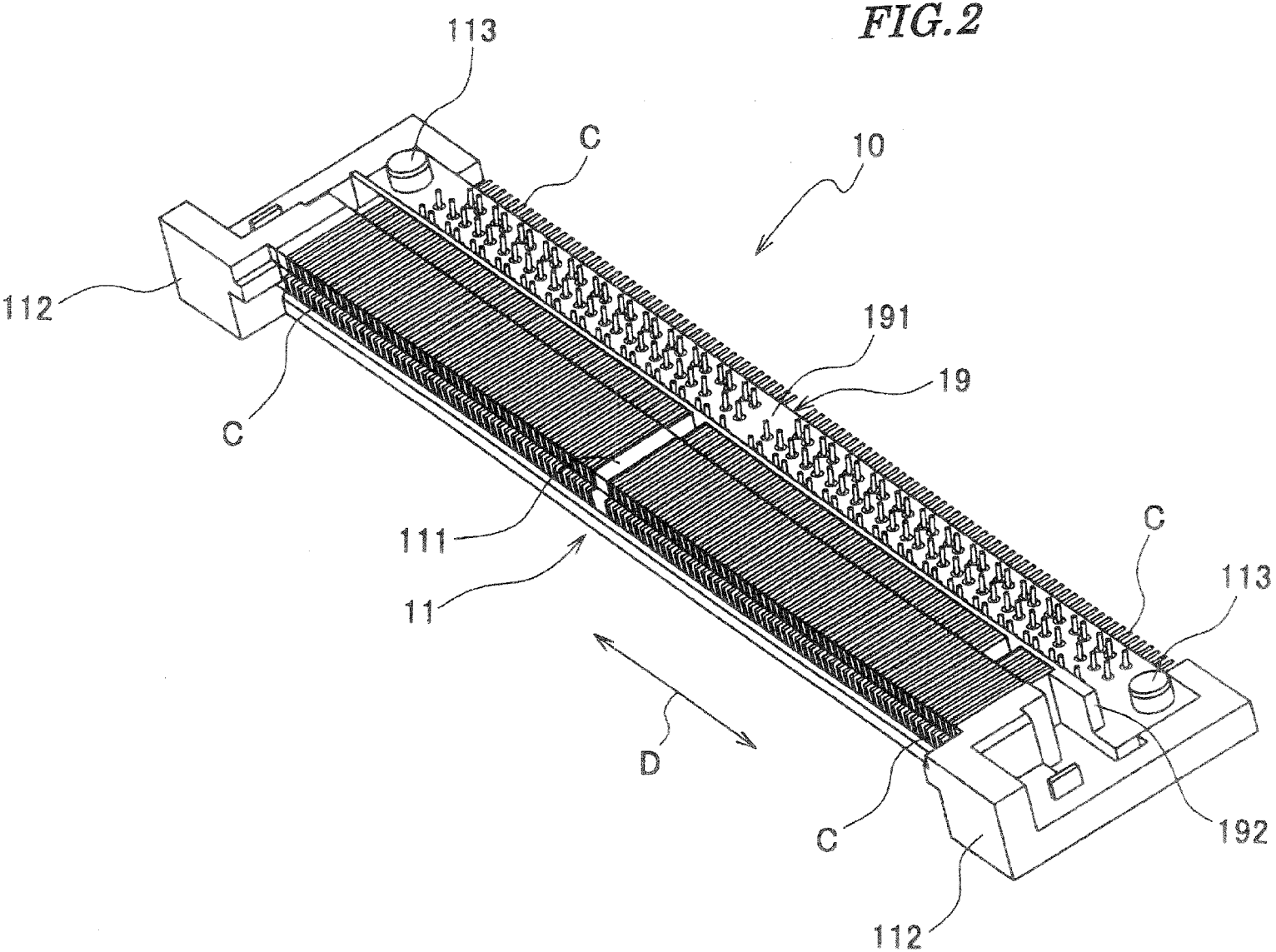
FIG. 2 is a perspective view of the FIG. 1 connector in a state inverted upside down.
Figure 3:
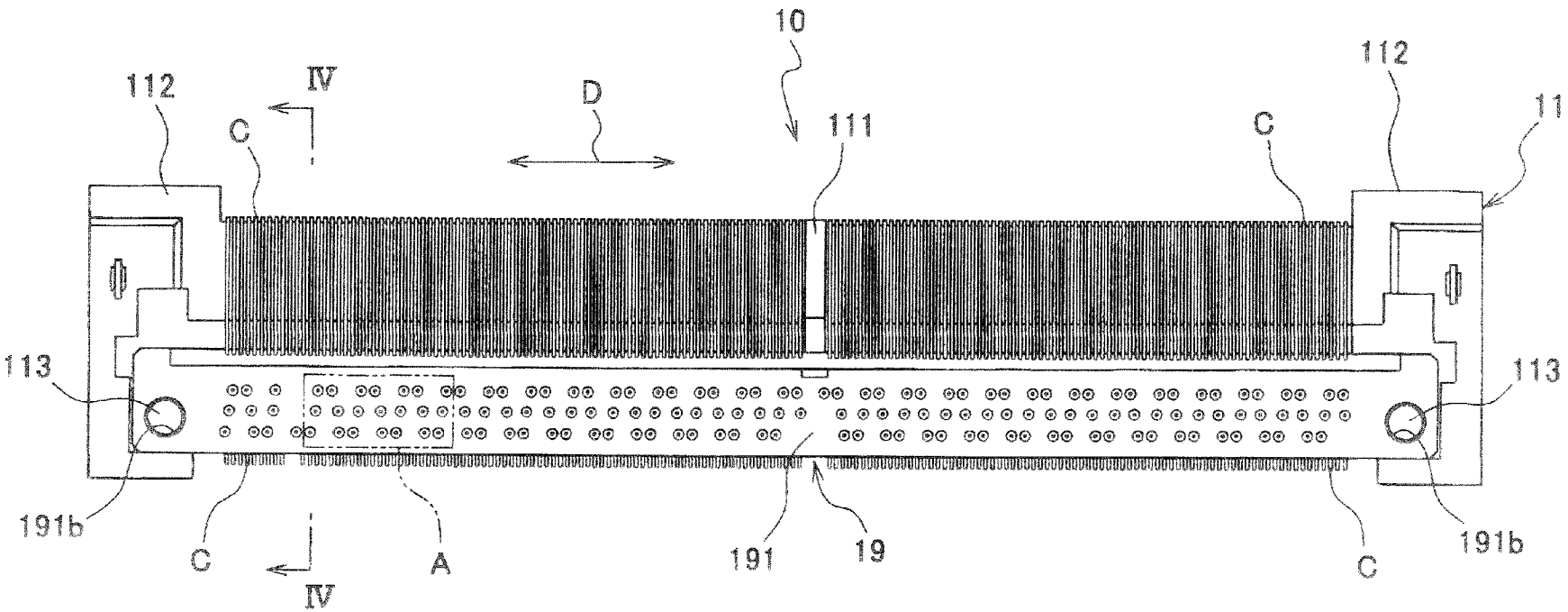
FIG. 3 is a bottom view of the FIG. 1 connector.

Referring to FIGS. 1, 2, and 3, a connector 10 is comprised of a housing 11, a plurality of contacts C, and a locator 19. The connector 10 is mounted on a printed wiring board (including printed circuit board), not shown (second object to be connected). The connector 10 electrically connects a card-type electronic device (first object to be connected), not shown, such as a memory card, a graphic card or the like, which is inserted into a receiving portion 111*a* (see FIG. 4) of the housing 11, and the printed wiring board, not shown, to each other.

The housing 11 includes a housing main body 111 and front wall portions 112.

Figure 4:
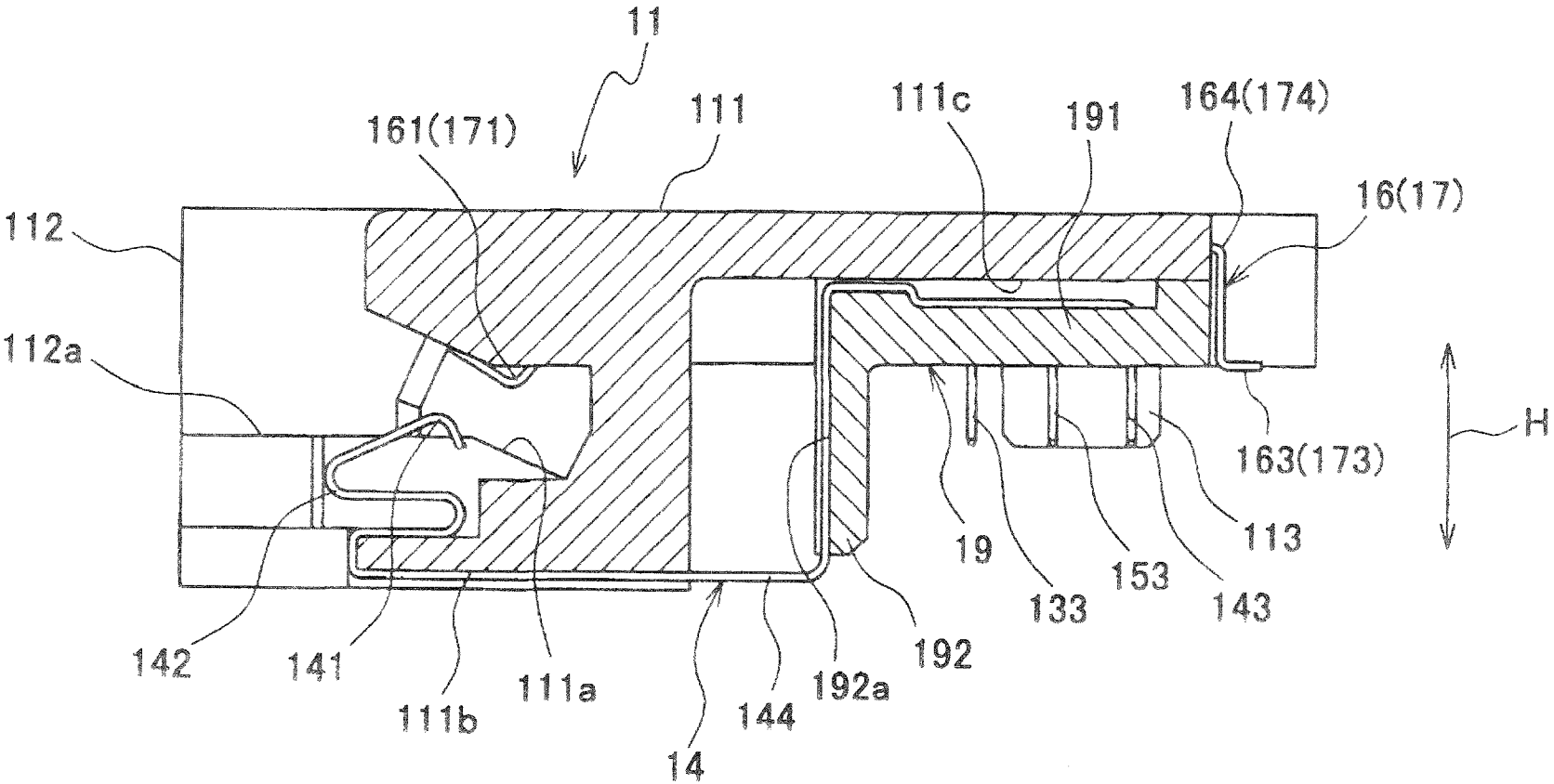
FIG. 4 is a cross-sectional view taken on line IV-IV in FIG. 3.

Referring to FIG. 4, the receiving portion 111*a* which receives a front end of the card-type electronic device is formed in a front portion of the housing main body 111 (a left portion, as viewed in FIG. 4). Grooves 111*b* are formed in a bottom surface of the front portion of the housing main body 111. The grooves 111*b* hold potions of the contacts C (connecting portions 134, 144, and 154 of signal contacts 13, 13', 14, and 14', and ground contacts 15, referred to hereinafter). An accommodating recess 111*c* which accommodates the locator 19 is formed in a bottom surface of a rear portion (a right potion, as viewed in FIG. 4) of the housing main body 111. Positioning pins 113 which are inserted in positioning holes, not shown, in the printed wiring board are formed at the opposite ends of the bottom surface of the housing main body 111.

The front wall portions 112 are continuous to the front portion of the housing main body 111. Each front wall portion 112 has an inner surface formed with a supporting surface 112*a* which supports the card-type electronic device inserted in the receiving portion 111*a*, in a state parallel to the printed wiring board.

Figure 5:
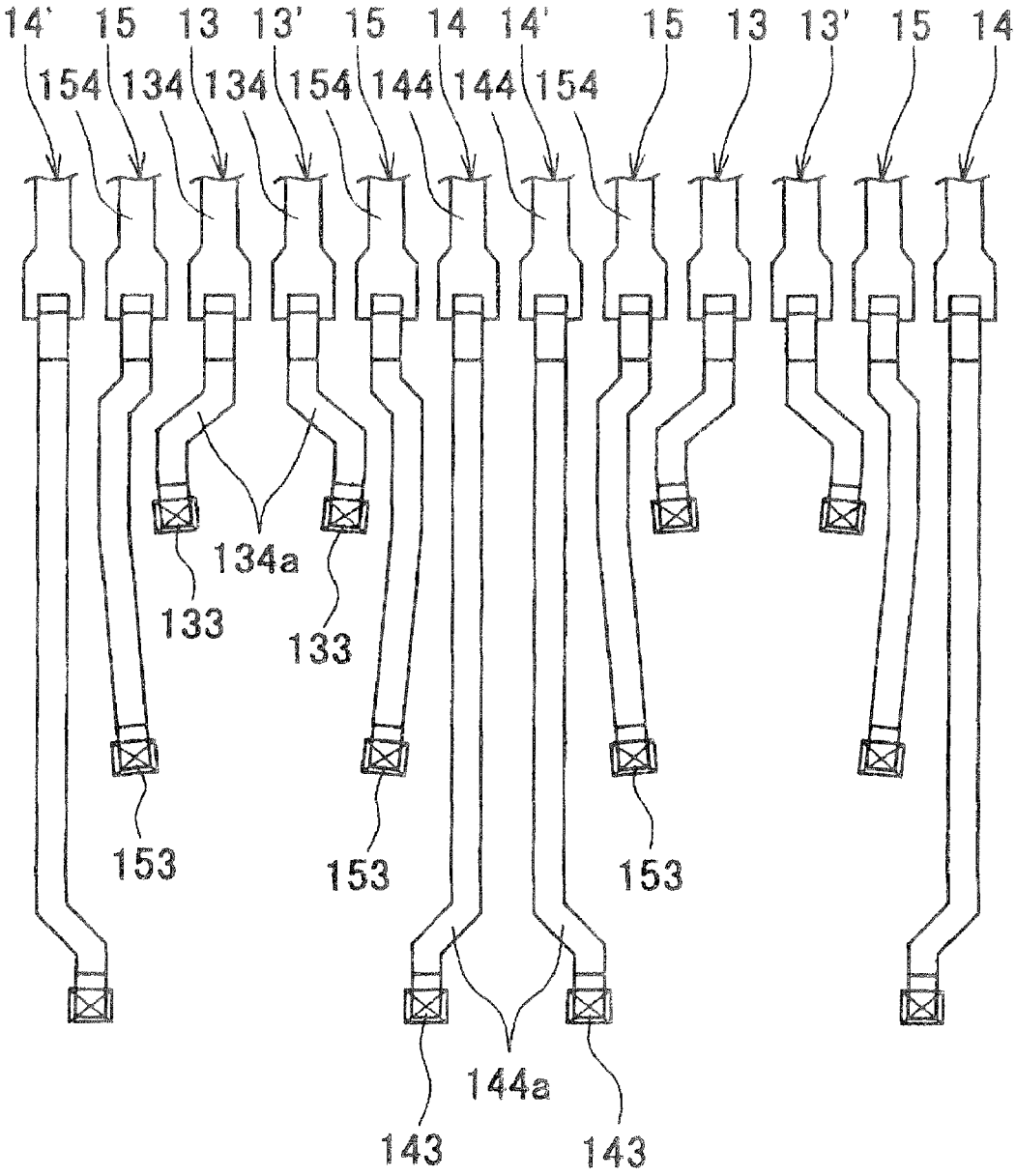
FIG. 5 is a plan view showing shapes of connecting portions of a plurality of contacts of the FIG. 1 connector.

The contacts C are arranged in the housing 11 along a predetermined arranging direction D. As shown in FIGS. 4 and 5, the contacts C include the signal contacts 13, 13', 14, and 14' of a through hole mount type, the ground contacts 15 of a through hole mount type, signal contacts 16 of a surface mount type, and ground contacts 17 of a surface mount type. The signal contacts 13, 13', 14, and 14', and the ground contacts 15 are disposed in a lower portion (lower portion, as viewed in FIG. 4) of the housing main body 111. The signal contacts 16 and the ground contacts 17 are disposed in an upper portion (upper portion, as viewed in FIG. 4) of the housing 11.

Each signal contact 13 and each signal contact 13' associated therewith form a pair of contacts for differential transmission. Since the signal contacts 13 and 13' each have the same shape, only the signal contact 13 will be described.

Each signal contact 13 includes a contact portion, not shown, a spring portion, not shown, a terminal portion 133, and the connecting portion 134. The contact portion of each signal contact 13 has the same shape as that of a contact portion 141, referred to hereinafter, of each signal contact 14. The contact portion of each signal contact 13 is brought into contact with an electrode, not shown, of the card-type electronic device which is inserted in the receiving portion 111*a*. The spring portion of each signal contact 13 has the same shape as that of a spring portion 142 of each signal contact 14. The spring portion of each signal contact 13 is continuous to the contact portion. The spring portion presses the contact portion against the electrode of the card-type electronic device. The terminal portion 133 is inserted through an associated one of through holes in the printed wiring board.

The spring portion extends from the contact portion, and the connecting portion 134 connects the contact portion and the terminal portion 133 via the spring portion. The connecting portion 134 includes a pitch-changing portion 134*a*. The pitch-changing portion 134*a* is substantially crank-shaped, and is used for making the arranging pitch of the terminal portions 133 larger than that of the contact portions.

Each signal contact 14 and each signal contact 14' associated therewith form a pair of contacts for differential transmission. Since the signal contacts 14 and 14' each have the same shape, only the signal contact 14 will be described.

Each signal contact 14 includes the contact portion 141, the spring portion 142, a terminal portion 143, and the connecting portion 144. The contact portion 141 is brought into contact with an electrode of the card-type electronic device which is inserted in the receiving portion 111*a*. The spring portion 142 is bent into a substantially S-shape, and is continuous to the contact portion 141. The spring portion 142 presses the contact portion 141 against the electrode of the card-type electronic device. The terminal portion 143 is inserted through the through hole of the printed wiring board.

The spring portion 142 extends from the contact portion 141, and the connecting portion 144 connects the contact portion 141 and the terminal portion 143 via the spring portion 142. The connecting portion 144 includes a pitch-changing portion 144*a*. The pitch-changing portion 144*a* is substantially crank-shaped, and is used for making the arranging pitch of the terminal portions 143 larger than that of the contact portions 141.

Each ground contact 15 (see FIG. 5) includes a contact portion, not shown, a spring portion, not shown, a terminal portion 153, and the connecting portion 154. The contact portion of each ground contact 15 has the same shape as that of the contact portion 141 of each signal contact 14. The contact portion of each ground contact 15 is brought into contact with an electrode of the card-type electronic device which is inserted in the receiving portion 111*a*. The spring portion of each ground contact 15 has the same shape as that of the spring portion 142 of each signal contact 14. The spring portion of each ground contact 15 is continuous to the contact portion. The spring portion presses the contact portion against the electrode of the card-type electronic device. The terminal portion 153 is inserted through an associated one of the through holes in the printed wiring board.

Figure 6:
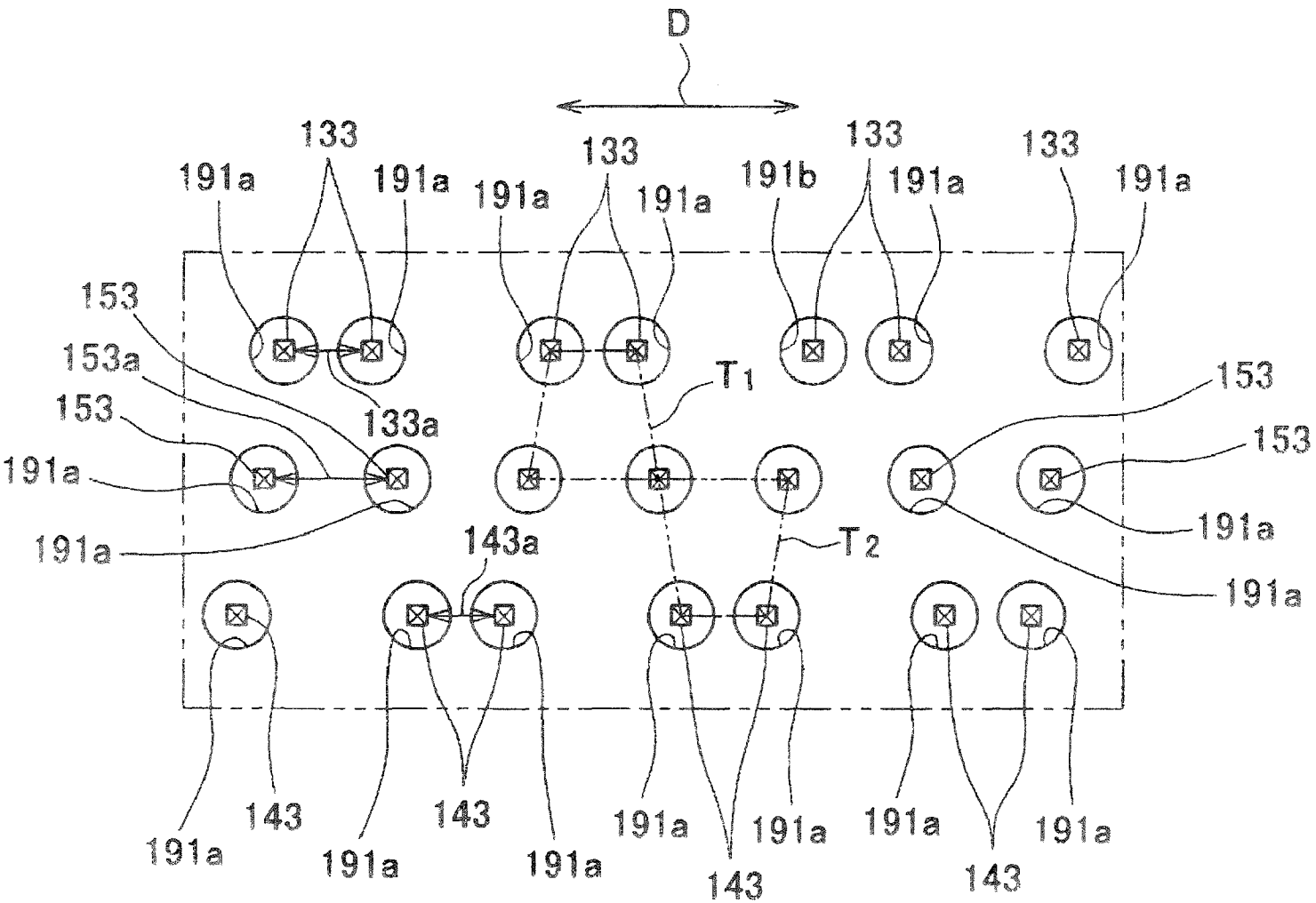
FIG. 6 is an enlarged view of a portion A in FIG. 3.

As shown in FIGS. 3 and 6, the terminal portions 133, 143, and 153 of the signal contacts 13, 13', 14, and 14', and the ground contacts 15 out of the contacts C are arranged in three rows parallel to one another along the arranging direction D. The row of the terminal portions 133 of the signal contacts 13 and 13' is located forward of the row of the terminal portions 143 of the signal contacts 14 and 14' in a longitudinal direction (in an upper area, as viewed in FIGS. 3 and 6) of the housing 11. The row of the terminal portions 153 of the ground contacts 15 is located between the row of the terminal portions 133 and the row of the terminal portions 143.

As shown in FIG. 6, spacing 133*a* between the terminal portions 133 and 133 of each pair of signal contacts 13 and 13' is narrower than spacing 153*a* between the terminal portions 153 and 153 of the ground contacts 15 and 15 adjacent to each other. Further, the spacing 153*a* between the terminal portions 153 and 153 of the ground contacts 15 and 15 adjacent to each other is larger than spacing 143*a* between the terminal portions 143 and 143 of each pair of signal contacts 14 and 14'.

As shown in FIG. 6, imaginary straight lines (two-dot chain lines in FIG. 6) connecting between the terminal portions 133 and 133 of each pair of signal contacts 13 and 13' and the terminal portions 153 and 153 of the two ground contacts 15 and 15 adjacent to each other which are located in the vicinity of the terminal portions 133 and 133 form a trapezoid T1. Further, imaginary straight lines (two-dot chain lines in FIG. 6) connecting between the terminal portions 143 and 143 of each pair of signal contacts 14 and 14' and the terminal portions 153 and 153 of the two ground contacts 15 and 15 adjacent to each other which are located in the vicinity of the terminal portions 143 and 143 form an inverted trapezoid T2.

The terminal portion 153 of each ground contact 15 is located on an imaginary straight line, not shown, which connects between the terminal portion 133 of one signal contact 13 (or 13') out of each pair of signal contacts 13 and 13', and the terminal portion 143 of one signal contact 14 (or 14') out of each pair of signal contacts 14 and 14', which is the nearest to the above-mentioned terminal portion 133.

Each signal contact 16 (see FIG. 4) is a contact for differential transmission, and two signal contacts 16 and 16 adjacent to each other form one pair.

Each signal contact 16 includes a contact portion 161, a spring portion, not shown, a terminal portion 163, and a connecting portion 164. The contact portion 161 is brought into contact with an electrode of the card-type electronic device which is inserted in the receiving portion 111*a*. The spring portion is continuous to the contact portion 161. The spring portion presses the contact portion 161 against the electrode of the card-type electronic device. The terminal portion 163 is surface-mounted on a pad on the printed wiring board. The spring portion extends from the contact portion 161, and the connecting portion 164 connects the contact portion 161 and the terminal portion 163 via the spring portion.

Each ground contact 17 (see FIG. 4) includes a contact portion 171, a spring portion, not shown, a terminal portion 173, and a connecting portion 174. Each ground contact 17 has the same shape as that of each signal contact 16, so that the reference numerals 17, 171, 173, and 174 of each ground contact 17 are indicated in parentheses beside the reference numerals 16, 161, 163, and 164 of each signal contact 16 in FIG. 4 for convenience sake, and a description thereof is omitted.

As shown in FIGS. 4 and 6, the locator 19 includes a locator main body 191 and a front wall portion 192. The locator main body 191 is plate-shaped. The locator main body 191 is formed with a plurality of holding holes 191*a* arranged in three rows along the arranging direction D. The plurality of holding holes 191*a* are arranged in the same manner as the terminal portions 133, 143, and 153. The terminal portions 133 of the signal contacts 13 and 13' are inserted through the holding holes 191*a* in a front row (upper row in FIG. 6). The terminal portions 153 of the ground contacts 15 are inserted through the holding holes 191*a* in a central row. The terminal portions 143 of the signal contacts 14 and 14' are inserted through the holding holes 191*a* in a rear row (lower row in FIG. 6). The locator main body 191 is formed with positioning holes 191*b* (see FIG. 3) at the opposite ends thereof. The positioning pins 113 of the housing 11 are inserted in the positioning holes 191*b* associated therewith. The positioning pins 113 are inserted in the positioning holes 191*b* associated therewith, whereby the locator 19 is positioned on the housing 11.

The front wall portion 192 is connected to a front portion of the locator main body 191. The front wall portion 192 is formed with a plurality of grooves 192*a*. The grooves 192*a* extend in a direction H of the height of the housing 11. Portions of the connection portions 134, 144, and 154 of the respective signal contacts 13, 13', 14, and 14', and the ground contacts 15 are held in the grooves 192*a*, respectively.

Figure 7:
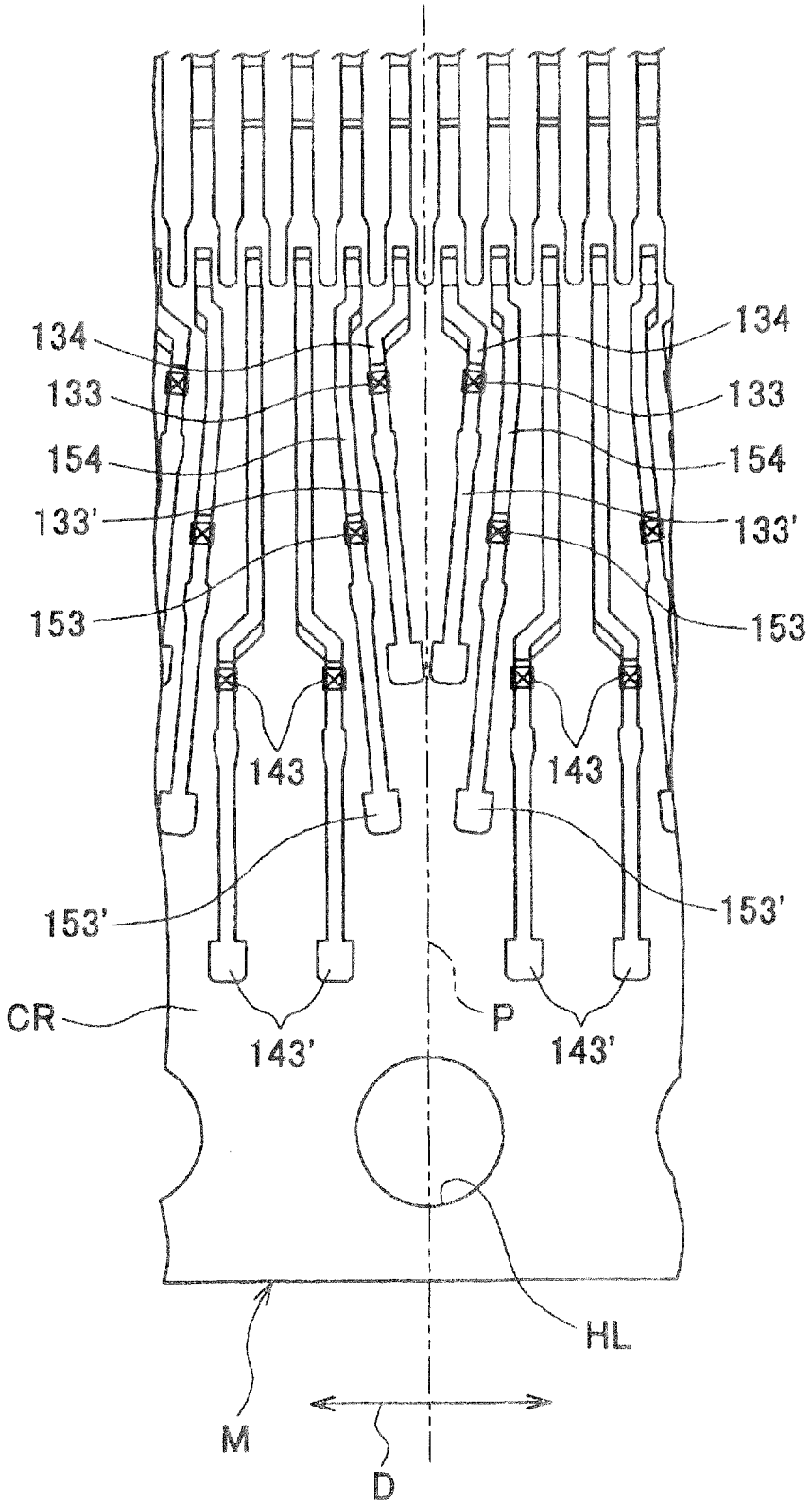
FIG. 7 is a partial plan view of the plurality of contacts of the FIG. 1 connector in a state connected by a carrier.

A description will be given of a method for manufacturing the signal contacts 13, 13', 14, and 14', and the ground contacts 15 of the connector 10 shown in FIG. 1 with reference to FIGS. 7 and 8.

The signal contacts 13, 13', 14, and 14', and the ground contacts 15 are blanked from one elastic metal plate M. At this time, the signal contacts 13, 13', 14, and 14', the ground contacts 15, and a carrier CR (portion in which a hole HL located at an end of the elastic metal plate M is bored) remain continuous. The cross-section of each of the signal contacts 13, 13', 14, and 14', and the ground contact 15 blanked from the elastic metal plate M is substantially square-shaped (see FIG. 6).

Figure 8:
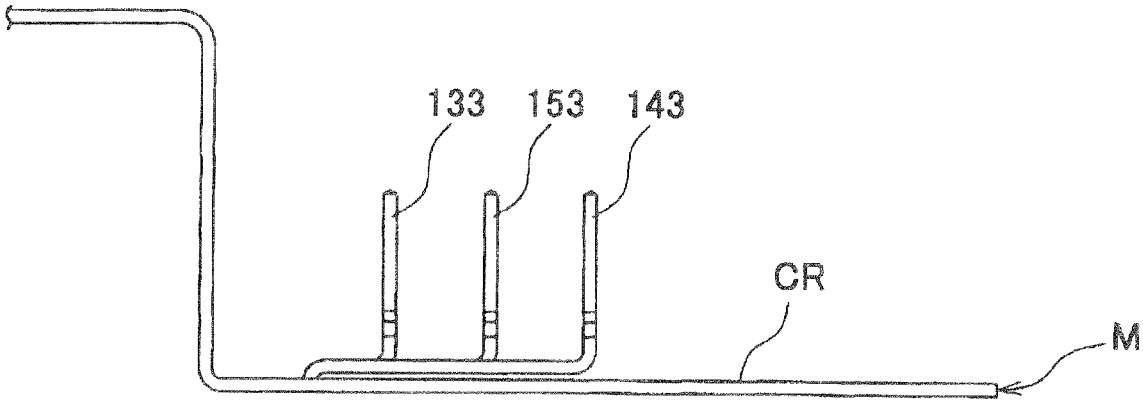
FIG. 8 is a side view of a plurality of contacts appearing in FIG. 7.

Although FIG. 8 shows the signal contacts 13, 13', 14, and 14', and the ground contacts 15 in a state the terminal portions 133, 143, and 153 are bent at the right angle after blanking, as is clear from shapes 133' and 153' of empty portions left after blanking the respective terminal portions 133 and 153, the terminal portions 133 and 153 before bending are inclined by a predetermined angle with respect to an imaginary plane P (see FIG. 1) orthogonal to the arranging direction D. Portions of the connecting portions 134 and 154 which are continuous to the respective terminal portions 133 and 153 are also inclined by the predetermined angle with respect to the imaginary plane P, similarly to the terminal portions 133 and 153. It should be noted that in FIG. 7, the imaginary plane P is indicated by an imaginary straight line.

Figure 9:
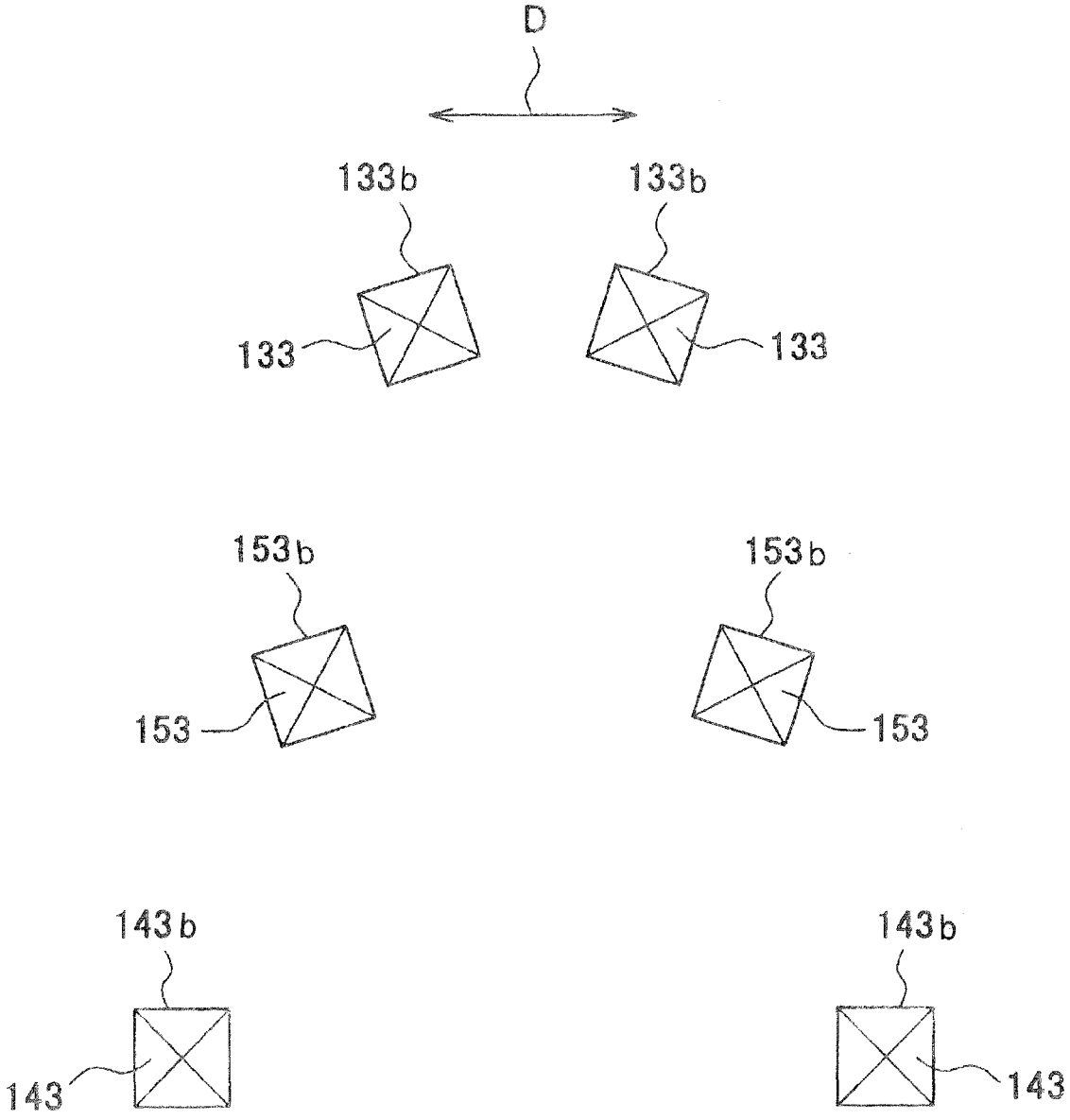
FIG. 9 is a conceptual view useful in explaining orientations of outer peripheral surfaces of terminal portions of the plurality of contacts of the FIG. 1 connector.

As shown in FIG. 8, the signal contacts 13, 13', 14, and 14', and the ground contacts 15 are bent into respective predetermined shapes. At this time, the terminal portions 133, 143, and 153 are bent at the right angles with respect to the carrier CR. Further, since the terminal portions 133 and 153, and portions of the connecting portions 134 and 154 of the respective signal contacts 13, and 13', and the ground contacts 15 before bending are inclined with respect to the imaginary plane P as mentioned above, when the terminal portions 133 and 153 are bent at right angles, as shown in FIG. 9, surfaces 133*b* and 153*b* of the terminal portions 133 and 153 facing toward the front wall portion 192 of the locator 19 are inclined with respect to the arranging direction D. That is, although the surface 143*b* of each of the signal contacts 14 and 14' is parallel to the arranging direction D, the surfaces 133*b* of each of the signal contacts 13 and 13', and the surface 153*b* of each ground contact 15 are not parallel to the arranging direction D.

By the above-described processes, the signal contacts 13, 13', 14, and 14', and the ground contacts 15 are completed in a state connected to the carrier CR.

To assemble the connector 10, first, the plurality of the signal contacts 13, 13', 14, and 14', and the ground contacts 15 in a state connected to the carrier CR are collectively mounted at a time on the housing 11 in which the signal contacts 16 and the ground contacts 17 are held by the so-called mold-in molding method in advance.

Next, the terminal portions 133, 143, and 153 of the respective signal contacts 13, 13', 14, and 14', and the ground contacts 15 are inserted through the respective associated holding holes 191*a* of the locator 19, and at the same time the locator 19 is accommodated in the accommodating recess 111*c* of the housing 11.

By the above-mentioned operations, the connector 10 is assembled.

According to the first embodiment, since portions of the connecting portions 134 and 154 and the terminal portions 133 and 153 of the signal contacts 13 and 13' and the ground contacts 15 are each inclined with respect to the imaginary plan P so as not to interfere with adjacent others of the contacts before bending, it is possible to reduce a non-blanked area of the elastic metal plate M, which makes it possible to eliminate the waste of the material of the elastic metal plate M.

Further, even if the signal contacts 13 and 13', the signal contacts 14 and 14', and the ground contacts 15 are formed from one elastic metal plate M, the spacings between the contact portions remain the same. Therefore, it is possible to mount the signal contacts 13 and 13', the signal contacts 14 and 14', and the ground contacts 15 on the housing 11 in a state connected to the carrier CR.

The signal contacts 13 and 13' forming each pair has the same length, and at the same time, the signal contacts 14 and 14' forming each pair also has the same length. This makes it possible to prevent occurrence of delayed phases, and makes transmission characteristics excellent.

Further, since the terminal portions 133, 143, and 153 are arranged in three rows, it is possible to secure sufficient spacings between each pair of the terminal portions 133, 143, and 153, which makes it possible to secure sufficient spacings between the adjacent ones of the through holes in the printed wiring board.

Although the terminal portions 133, 143, and 153 of the signal contacts 13 and 13', the signal contacts 14 and 14', and the ground contacts 15 of the connector 10 of the present embodiment have pin shapes of a through hole mount type, they may have a flat shape of a surface mount type, instead. Further, if an object to be connected to the terminal portions is a connector, each terminal portion may be formed into a shape which can be connected to the mating connector.

Further, although the terminal portions 133, 143, and 153 of the signal contacts 13 and 13', the signal contacts 14 and 14', and the ground contacts 15 are arranged in three rows (see FIG. 6), it is not necessarily required to arrange them in this manner, but the terminal portions of the signal contacts and the terminal portions of the ground contacts may be arranged in two rows (this variation is not shown).

It should be noted that although in this embodiment, the present invention is applied to the connector for differential transmission, the object to be applied is not limited to this.

Further, although in this embodiment, each ground contact 15 is disposed between the pair of signal contacts 13 and 13' and the pair of signal contacts 14 and 14', associated therewith, it is not necessarily required to arrange the contacts in this manner.

It should be noted that although in this embodiment, the first object to be connected is the card-type electronic device, and the second object to be connected is the printed wiring board, the first and second objects to be connected are not limited to these.

Further, although in this embodiment, portions of the connecting portions 134 and 154 and the terminal portions 133 and 153 of the signal contacts 13 and 13' and the ground contacts 15, out of the signal contacts 13, 13', 14, and 14', and the ground contacts 15 are inclined with respect to the imaginary plane P, portions of the connecting portions 134, 144, and 154 and the terminal portions 133, 143, and 153 of the signal contacts 13, 13', 14, and 14', and the ground contacts 15 may be inclined with respect to the imaginary plane P.

Next, a description will be given of a connector according to a second embodiment of the present invention with reference to FIGS. 10 to 15. It should be noted that in FIGS. 11, 13, and 15, signal contacts 213 and 213', signal contacts 214', and ground contact 215 and 215 cannot be seen behind signal contacts 214, so that the reference numerals of the signal contacts 213 and 213', the signal contacts 214', and the ground contacts 215 and 215 are indicated in parenthesis.

Further, component parts identical to those of the connector according to the first embodiment are designated by identical reference numerals, and detailed description thereof is omitted, while only main component parts different in construction from those of the first embodiment will be described hereinafter.

Figure 14:
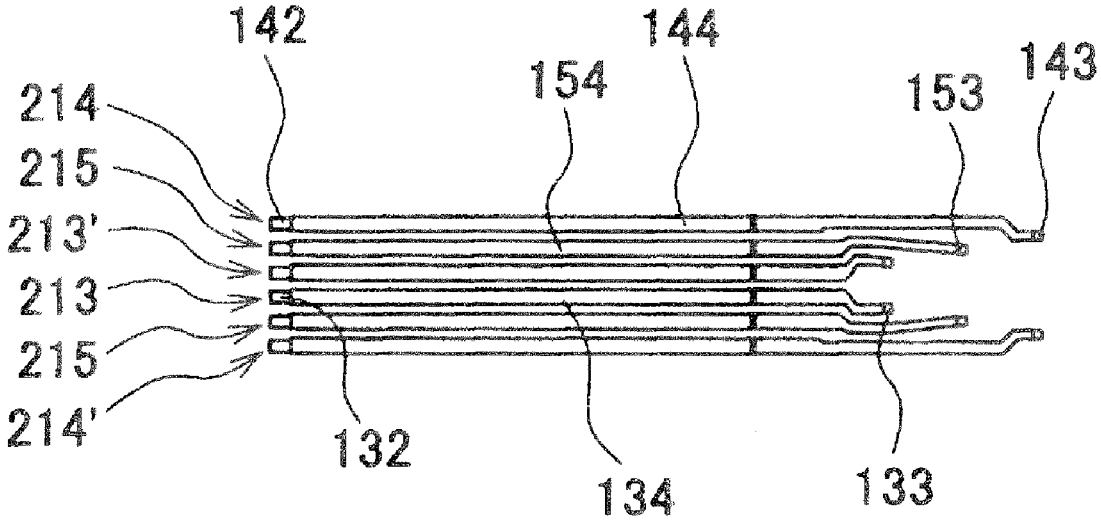
FIG. 14 is a bottom view of the plurality of contacts in a state in which terminal portions of the contacts are in a bent state.
Figure 15:
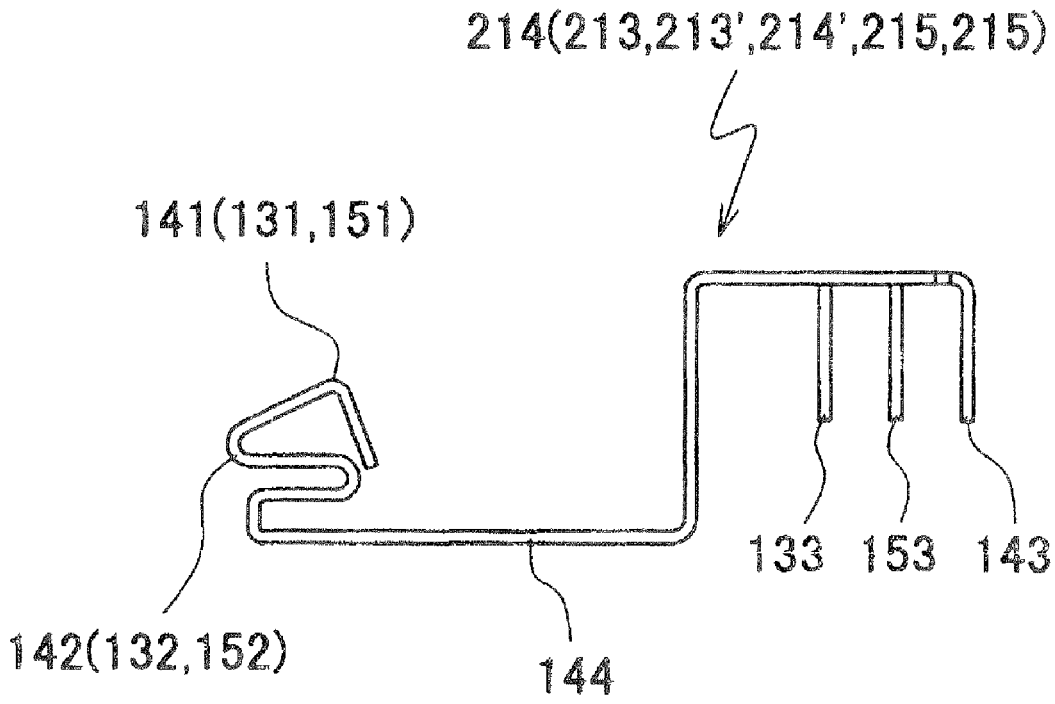
FIG. 15 is a side view of each contact appearing in FIG. 14.

Similarly to the connector of the first embodiment, as shown in FIGS. 14 and 15, the connector of the second embodiment includes the signal contacts 213 and 213', the signal contacts 214 and 214', and the ground contacts 215 and 215.

Figure 10:
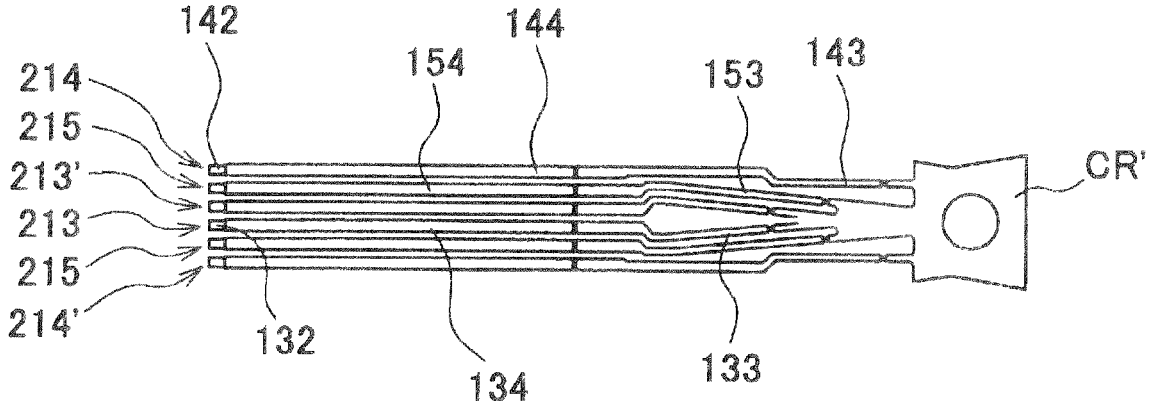
FIG. 10 is a bottom view of a plurality of contacts of a connector according to a second embodiment of the present invention in a state before being removed from a carrier.
Figure 11:
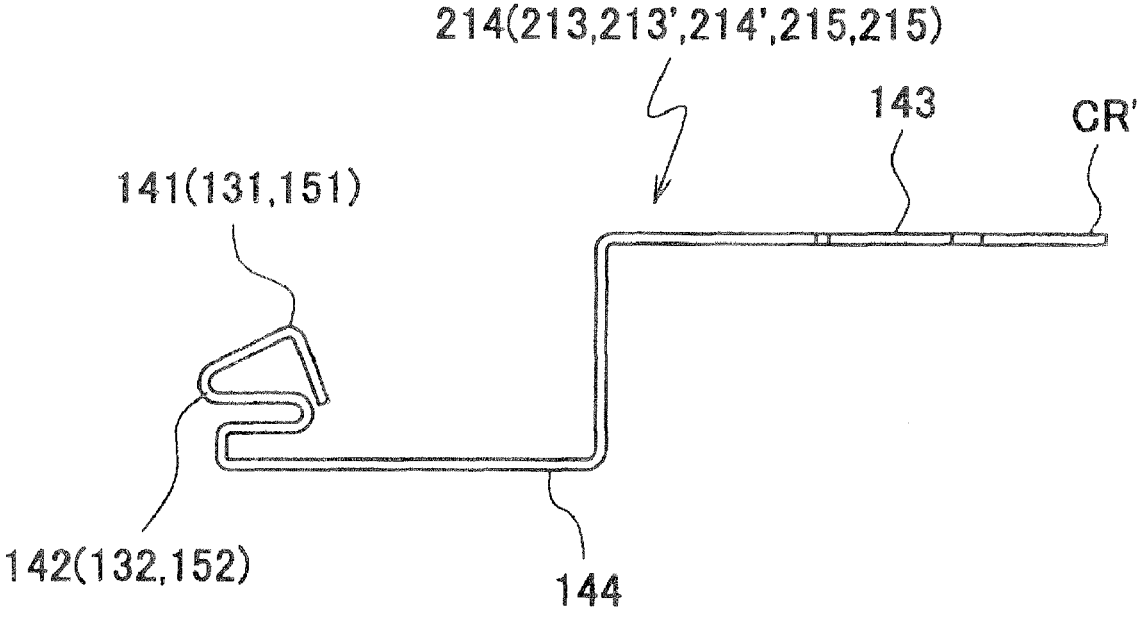
FIG. 11 is a side view of each contact appearing in FIG. 10.

Further, although in the first embodiment, the terminal portions 133, 143, and 153 of the respective signal contacts 13 and 13', the signal contacts 14 and 14', and the ground contacts 15 and 15 are connected to the carrier CR, in the second embodiment, as shown in FIGS. 10 and 11, the terminal portions 133, 143, and 153 of the signal contacts 213 and 213', the signal contacts 214 and 214', and the ground contacts 215 and 215 are connected to a carrier CR'.

Next, a description will be given of a method for manufacturing the contacts of the connector of the second embodiment.

First, contact portions 131, 141, and 151, spring portions 132, 142, and 152, terminal portions 133, 143, and 153, and connecting portions 134, 144, and 154 of the respective signal contacts 213 and 213', the signal contacts 214 and 214', and the ground contacts 215 and 215 are blanked from one elastic metal plate (see FIG. 10). The blanked terminal portions 133, 143, and 153 remain connected to the carrier CR'.

Next, as shown in FIG. 11, the contact portions 131, 141, and 151, the spring portions 132, 142, and 152, and the connecting portions 134, 144, and 154 are bent into respective predetermined shapes.

Figure 12:
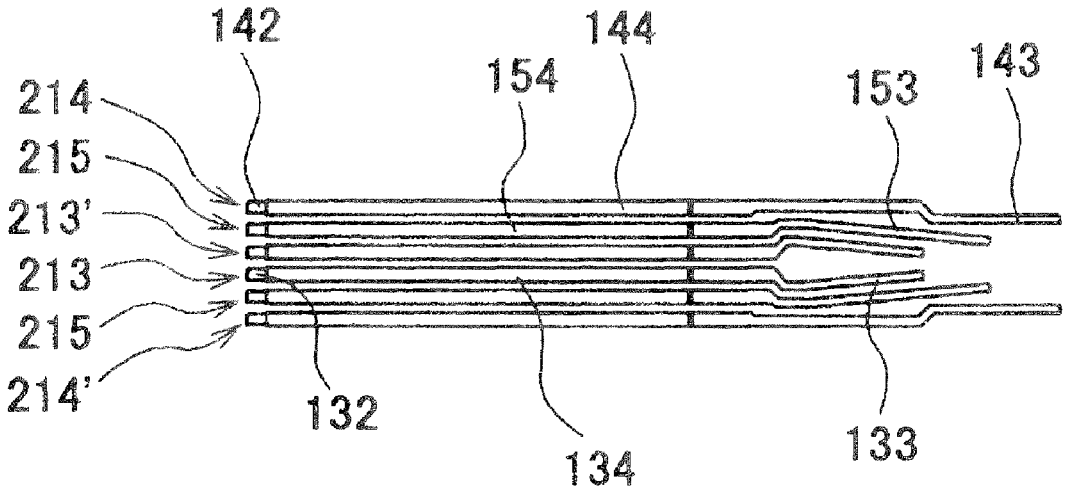
FIG. 12 is a bottom view of the plurality of contacts in a state removed from the carrier.
Figure 13:
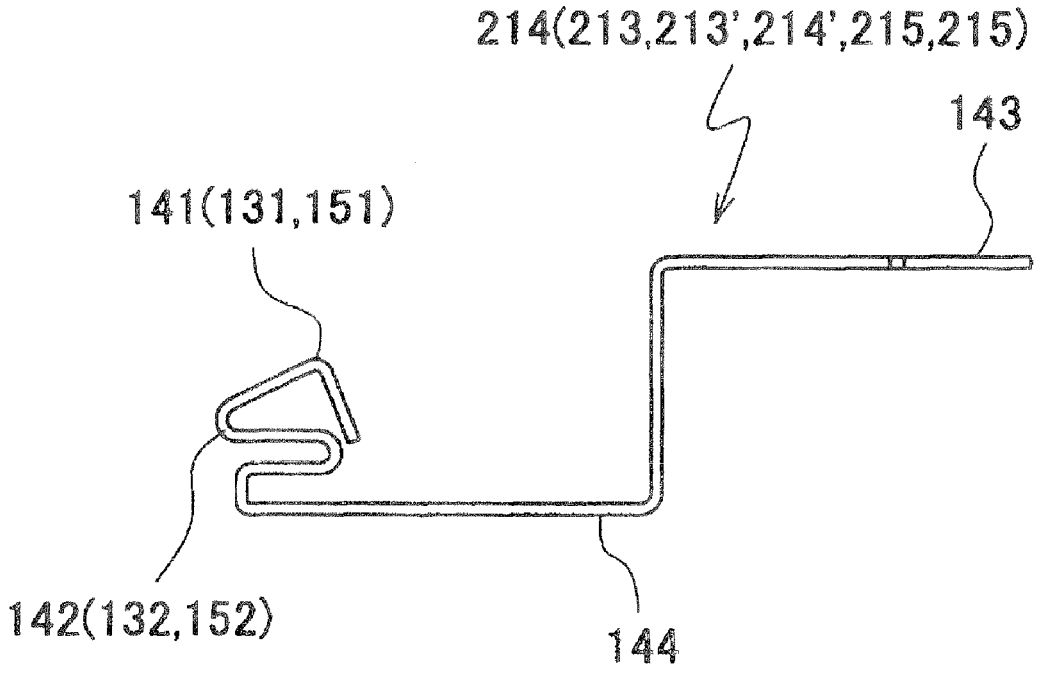
FIG. 13 is a side view of each contact appearing in FIG. 12.

Thereafter, as shown in FIGS. 12 and 13, the carrier CR' is removed from the terminal portions 133, 143, and 153 by blanking.

Finally, as shown in FIGS. 14 and 15, the terminal portions 133, 143, and 153 are bent at right angles.

It should be noted that the signal contacts 213 and 213', the signal contacts 214 and 214', and the ground contacts 215 and 215 obtained as above may be separately mounted on a housing, not shown, or these contacts may be collectively mounted on the housing at a time by using a jig.

According to the second embodiment, it is possible to obtain the same advantageous effects as provided by the first embodiment.

In addition to the above-described manufacturing method, there is the following method: First, the signal contacts 213 and 213', the signal contacts 214 and 214', and the ground contacts 215 and 215 are mounted on the housing in a state in which the terminal portions 133, 143, and 153 are connected to the carrier CR', and then, the carrier CR' is removed from the terminal portions 133, 143, and 153, and finally, the terminal portions 133, 143, and 153 are bent at right angles.

It is further understood by those skilled in the art that the foregoing are the preferred embodiments of the present invention, and that various changes and modification may be made thereto without departing from the spirit and scope thereof.

What is claimed is:

1. A connector as comprising:

a housing; and a plurality of contacts which are formed by at least blanking an elastic metal plate, and which are held by said housing in a predetermined arranging direction, said contacts each including a contact portion which is brought into contact with a first object to be connected, a terminal portion which is connected to a second object to be connected, and a connecting portion which connects said contact portion and said terminal portion;

wherein portions of said connecting portions and said terminal portions of at least part of the plurality of contacts are inclined by a predetermined angle with respect to an imaginary surface orthogonal to the arranging direction so as not to interfere with other adjacent ones of said contacts during blanking, wherein the plurality of contacts include a plurality of pairs of signal contacts and a plurality of ground contacts, wherein said terminal portions of said signal contacts and said terminal portions of said ground contacts are arranged in two rows parallel to each other along the arranging direction, and wherein imaginary straight lines connecting between said terminal portions of each pair of signal contacts in the row of said terminal portions of said signal contacts, and said terminal portions of each adjacent two of said ground contacts in the row of said terminal portions of said ground contacts, which are located in the vicinity of said terminal portions of the pair of said signal contacts, form a trapezoid.

2. A connector comprising:

a housing; and a plurality of contacts which are formed by at least blanking an elastic metal plate, and which are held by said housing in a predetermined arranging direction, said contacts each including a contact portion which is brought into contact with a first object to be connected, a terminal portion which is connected to a second object to be connected, and a connecting portion which connects said contact portion and said terminal portion;

wherein portions of said connecting portions and said terminal portions of at least part of the plurality of contacts are inclined by a predetermined angle with respect to an imaginary surface orthogonal to the arranging direction so as not to interfere with other adjacent ones of said contacts during blanking, wherein the plurality of contacts are formed by bending after being blanked, wherein the plurality of contacts each have a substantially square cross-section, wherein said terminal portion of each of the plurality of contacts has a pin shape which is insertable through an associated one of through holes formed in the second object to be connected, wherein one surface of said terminal portions of at least part of the plurality of contacts is inclined by a predetermined angle with respect to the arranging direction, when in a state having been bent, wherein the plurality of contacts include a plurality of pairs of signal contacts and a plurality of ground contacts, wherein said terminal portions of said signal contacts and said terminal portions of said ground contacts are arranged in two rows parallel to each other along the arranging direction, and wherein imaginary straight lines connecting between said terminal portions of each pair of signal contacts in the row of said terminal portions of said signal contacts, and said terminal portions of each adjacent two of said ground contacts in the row of said terminal portions of said ground contacts, which are located in the vicinity of said terminal portions of the pair of said signal contacts, form a trapezoid.

3. A connector comprising:

a housing; and a plurality of contacts which are formed by at least blanking an elastic metal plate, and which are held by said housing in a predetermined arranging direction, said contacts each including a contact portion which is brought into contact with a first object to be connected, a terminal portion which is connected to a second object to be connected, and a connecting portion which connects said contact portion and said terminal portion;

wherein portions of said connecting portions and said terminal portions of at least part of the plurality of contacts are inclined by a predetermined angle with respect to an imaginary surface orthogonal to the arranging direction so as not to interfere with other adjacent ones of said contacts during blanking, wherein the plurality of contacts include a plurality of pairs of signal contacts and a plurality of ground contacts, wherein said terminal portions of said signal contacts are arranged in two rows parallel to each other along the arranging direction, wherein said terminal portions of said ground contacts are arranged in a row in the arranging direction between one row and the other row of said terminal portions of said signal contacts, wherein imaginary straight lines connecting between said terminal portions of each pair of signal contacts in the one row of said terminal portions of said signal contacts, and said terminal portions of each two of said ground contacts, which are located in the vicinity of said terminal portions of said signal contacts, form a trapezoid, and wherein imaginary straight lines connecting between said terminal portions of each pair of signal contacts in the other row of said terminal portions of said signal contacts, and said terminal portions of each two of said ground contacts, which are located in the vicinity of said terminal portions of said signal contacts, form an inverted trapezoid.

4. A connector comprising:

a housing; and a plurality of contacts which are formed by at least blanking an elastic metal plate, and which are held by said housing in a predetermined arranging direction, said contacts each including a contact portion which is brought into contact with a first object to be connected, a terminal portion which is connected to a second object to be connected, and a connecting portion which connects said contact portion and said terminal portion;

wherein portions of said connecting portions and said terminal portions of at least part of the plurality of contacts are inclined by a predetermined angle with respect to an imaginary surface orthogonal to the arranging direction so as not to interfere with other adjacent ones of said contacts during blanking, wherein the plurality of contacts are formed by bending after being blanked, wherein the plurality of contacts each have a substantially square cross-section, wherein said terminal portion of each of the plurality of contacts has a pin shape which is insertable through an associated one of through holes formed in the second object to be connected, wherein one surface of said terminal portions of at least part of the plurality of contacts is inclined by a predetermined angle with respect to the arranging direction, when in a state having been bent, wherein the plurality of contacts include a plurality of pairs of signal contacts and a plurality of ground contacts, wherein said terminal portions of said signal contacts are arranged in two rows parallel to each other along the arranging direction, wherein said terminal portions of said ground contacts are arranged in a row in the arranging direction between one row and the other row of said terminal portions of said signal contacts, wherein imaginary straight lines connecting between said terminal portions of each pair of signal contacts in the one row of said terminal portions of said signal contacts, and said terminal portions of each two of said ground contacts, which are located in the vicinity of said terminal portions of said signal contacts, form a trapezoid, and wherein imaginary straight lines connecting between said terminal portions of each pair of signal contacts in the other row of said terminal portions of said signal contacts, and said terminal portions of each two of said ground contacts, which are located in the vicinity of said terminal portions of said signal contacts, form an inverted trapezoid.

5. A connector as claimed in claim 1, wherein said contact portions of said ground contacts are each disposed between said contact portions of adjacent ones of the pairs of said signal contacts in the arranging direction.

6. A connector as claimed in claim 2, wherein said contact portions of said ground contacts are each disposed between said contact portions of adjacent ones of the pairs of said signal contacts in the arranging direction.

7. A connector as claimed in claim 3, wherein said contact portions of said ground contacts are each disposed between said contact portions of adjacent ones of the pairs of said signal contacts in the arranging direction.

8. A connector as claimed in claim 4, wherein said contact portions of said ground contacts are each disposed between said contact portions of adjacent ones of the pairs of said signal contacts in the arranging direction.

* * * * *